US005088115A

United States Patent [19]

Napolitano

[11] Patent Number: 5,088,115

[45] Date of Patent: Feb. 18, 1992

[54] VENTILATED FULL BODY PROTECTIVE GARMENT

[75] Inventor: Michael L. Napolitano, Georgetown, Ky.

[73] Assignee: E. D. Bullard Company, Sausalito, Calif.

[21] Appl. No.: 626,542

[22] Filed: Dec. 12, 1990

[51] Int. Cl.[5] ..... A41D 13/00

[52] U.S. Cl. ..... 2/69; 2/81; 2/84; 2/2.1 A; 2/DIG. 1

[58] Field of Search ..... 2/69, 81, 84, 2.1 A, 2/DIG. 1

[56] References Cited

U.S. PATENT DOCUMENTS

| | | | |
|---|---|---|---|
| 2,709,667 | 5/1955 | Grubb et al. | 2/81 |
| 2,826,758 | 3/1958 | Kahn | 2/81 |
| 2,994,089 | 8/1961 | Ferguson, Jr. et al. | 2/81 |
| 3,113,320 | 12/1963 | Cherowbrier et al. | 2/81 |
| 4,271,833 | 6/1981 | Moretti | 2/DIG. 1 |
| 4,403,608 | 9/1983 | Warncke | 2/2.1 A |
| 4,860,382 | 8/1989 | Markwell | 2/69 |
| 4,864,654 | 9/1989 | Schriver et al. | 2/69 |
| 4,876,746 | 10/1989 | Howie | 2/81 |
| 4,901,370 | 2/1990 | Suba | 2/81 |

FOREIGN PATENT DOCUMENTS

| | | | |
|---|---|---|---|
| 2151457 | 7/1985 | United Kingdom | 2/69 |

*Primary Examiner*—Werner H. Schroeder
*Assistant Examiner*—Gloria Hale
*Attorney, Agent, or Firm*—Maurice L. Miller, Jr.

[57] ABSTRACT

A full body garment made of flexible, non-stretchable, air impervious material which can be supplied with breathable, ventilating air from a remote source, for protecting a wearer when present in a contaminated atmosphere is disclosed. The garment includes a loose fitting body suit containing a shirt portion having two separate inner and outer layers of long sleeves, a manually cinchable neck opening, a long pants portion having separate inner and outer layers of legs joined together at and extending below the knee region, and a pair of gloves and foot covers joined in an air tight manner to the inner layers of the sleeves and legs, respectively. A loose fitting parka is also included which contains a slip over torso covering portion having sleeves with elastic bands around open ends thereof and an elastic waist band, a respirator hood, and a shoulder, upper chest and back encircling bib. A back portion of the suit contains a pair of exhalation valves for expelling excess air from the suit into a space between the shirt and torso covering portions. Excess air is expelled from the space to ambient atmosphere across the waist and sleeve bands to permit extensive upper body movement with relative ease. A pair of overlying positive air pressure barrier is thus provided in an upper body region of the garment to protect the upper body of the wearer from contact with air borne contaminates in the ambient atmosphere.

11 Claims, 2 Drawing Sheets

FIG. 2
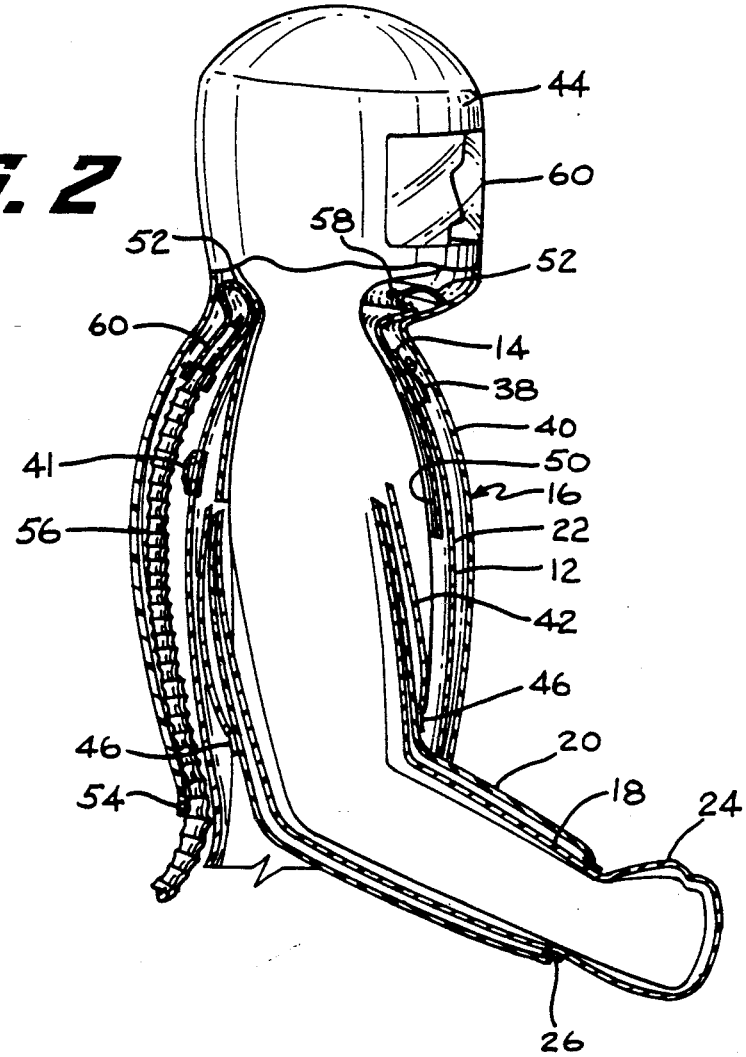
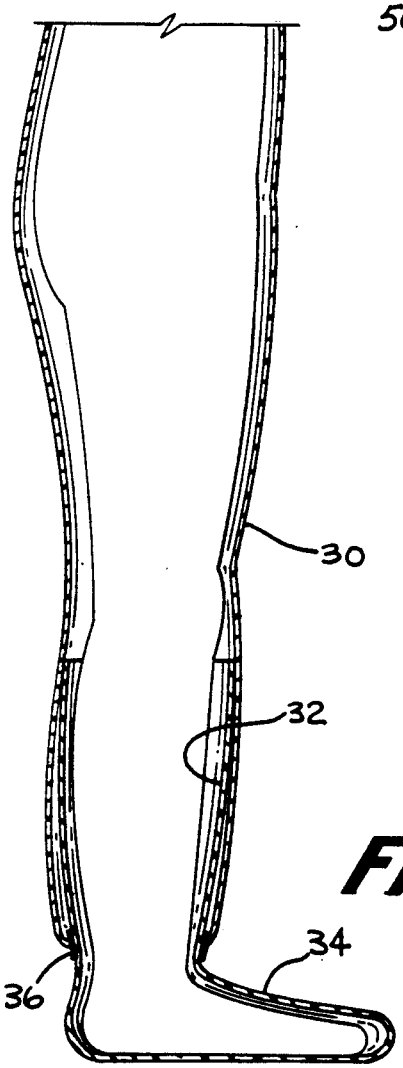
FIG. 3

VENTILATED FULL BODY PROTECTIVE GARMENT

BACKGROUND OF THE INVENTION

This invention relates to a full body protective garment suppliable with breathable ventilating air from a remote source which provides the wearer with a double, positive air pressure barrier about the upper body portion of the suit to inhibit upper body contact with air borne contaminants present in an ambient atmospheric work environment.

Generally speaking, protective garments for workers have long been known and used in the prior art. Moreover, double layer protective suits adapted for being supplied with breathable ventilating air from a remote source have also been known to the prior art as for example, the double layer suit disclosed in U.S. Pat. No. 4,271,833 issued to A. L. Moretti on June 9, 1981. The reference double layer suit provides for the distribution of breathable air from a pressurized remote source into an inner head enclosure of a double layered hood for respiration by the wearer. It also provides for the distribution of ventilating air about the limbs of the wearer between double layers of both the sleeves and the pants legs for maintaining a positive air pressure between the sleeve and leg layers. However, since the ends of the sleeves and pant legs are loose and open about the wearer's wrist and ankles respectively, air supplied to the space between the inner and outer layers readily escapes to ambient atmosphere.

For this reason, the subject patent recommends the garment primarily for use in cooling and ventilating the users limbs and only secondarily for assisting in preventing infiltration of air borne contaminates through the outer layer of the garment when the outer layer is formed of an air permeable material. Because of the fact that the outer sleeve of the reference suit are open and loose, the air space between the two sleeve layers is therefore susceptable to infiltration by air borne contaminates from the ambient environment even when the outer and inner layers of the garment are formed of air impervious material. However, since the referenced garment does not provide for ventilating air to be distributed under the inner garment, it is not likely that the inner garment would be suitable when constructed of an air impervious material. In any event, the reference garment does not provide for overlapping positive air pressure barriers in the upper body portion thereof. Accordingly, it can not directly ventilate the wearer's full body and merely assists in preventing infiltration of air borne contaminants by means of a single positive pressure air barrier.

By means of my invention, these and other difficulties encountered with prior art supplied air protective garments is substantially eliminated.

SUMMARY OF THE INVENTION

It is an object of my invention to provide an improved full body garment for protecting a worker or other person from exposure to air borne contaminates present in the ambient environment.

It is another object of my invention to provide a ventilatable full body protective garment featuring two overlying positive air pressure barriers in an upper body portion of the garment for enhanced protection against exposure of an upper body portion of the wearer to air borne contaminates in the ambient environment.

It is yet another object of my invention to provide a ventilatable full body protective garment which provides enhanced protection to the wearer against exposure to air borne contaminates of the ambient atmosphere while providing for excess air to be exhausted from the garment to permit full body movement of the wearer with relative ease.

It is also an object of my invention to provide a supplied air, full body protective garment which provides for enhanced protection to the wearer against exposure to air borne contaminates of the ambient atmosphere while also providing for circulation of breathable air about a respirator hood of the garment and circulation of ventilating air substantially fully about the wearers entire body.

Briefly, in accordance with my invention, there is provided a ventilatable full body protective garment for use in a contaminated atmospheric environment. The garment includes a body suit having a long pants portion, a shirt portion containing a pair of long sleeves and a manually cinchable neck opening, a pair of gloves and a pair of foot covers, all being joined together in an air tight manner. Means is provided for venting excess air from the suit through the shirt portion such that the pressure of air within an upper body region of the suit does not exceed a predetermined maximum value. A parka is also provided including a pull-over torso covering portion having a pair of sleeves containing elastic bands and an elastic waist band for closing around the arms and waist respectively, of the wearer, a supplied air respirator hood attached to and around a neck opening of the torso covering portion, and means for directing excess air from the hood through the neck opening of the shirt portion into said suit, whereby excess air is vented from the suit through the shirt circulates in a space between said shirt and torso covering portions to form a pair of overlying positive pressure air barriers in the upper body region of the garment to inhibit exposure of the wearer to air borne contaminates contained in the ambient atmosphere and excess air is vented from the space to ambient atmosphere across said waist and sleeve bands to permit extensive upper body movement with relative ease. The fabric from which the suit and parka means is constructed comprises a flexible, air impervious, non-stretchable material.

These and other objects, features and advantages of my invention will become apparent to those skilled in the art from the following detailed description and attached drawings upon which, by way of example, only a single preferred embodiment of my invention is illustrated.

BRIEF DESCRIPTION OF THE DRAWINGS

FIG. 2 shows a partially cross-sectioned side elevation view of an upper body portion of the person and garment of FIG. 1.

FIG. 3 shows a cross sectioned side elevation view of a lower portion of the garment of FIGS. 1-2.

DESCRIPTION OF THE PREFERRED EMBODIMENT

Figure 1:
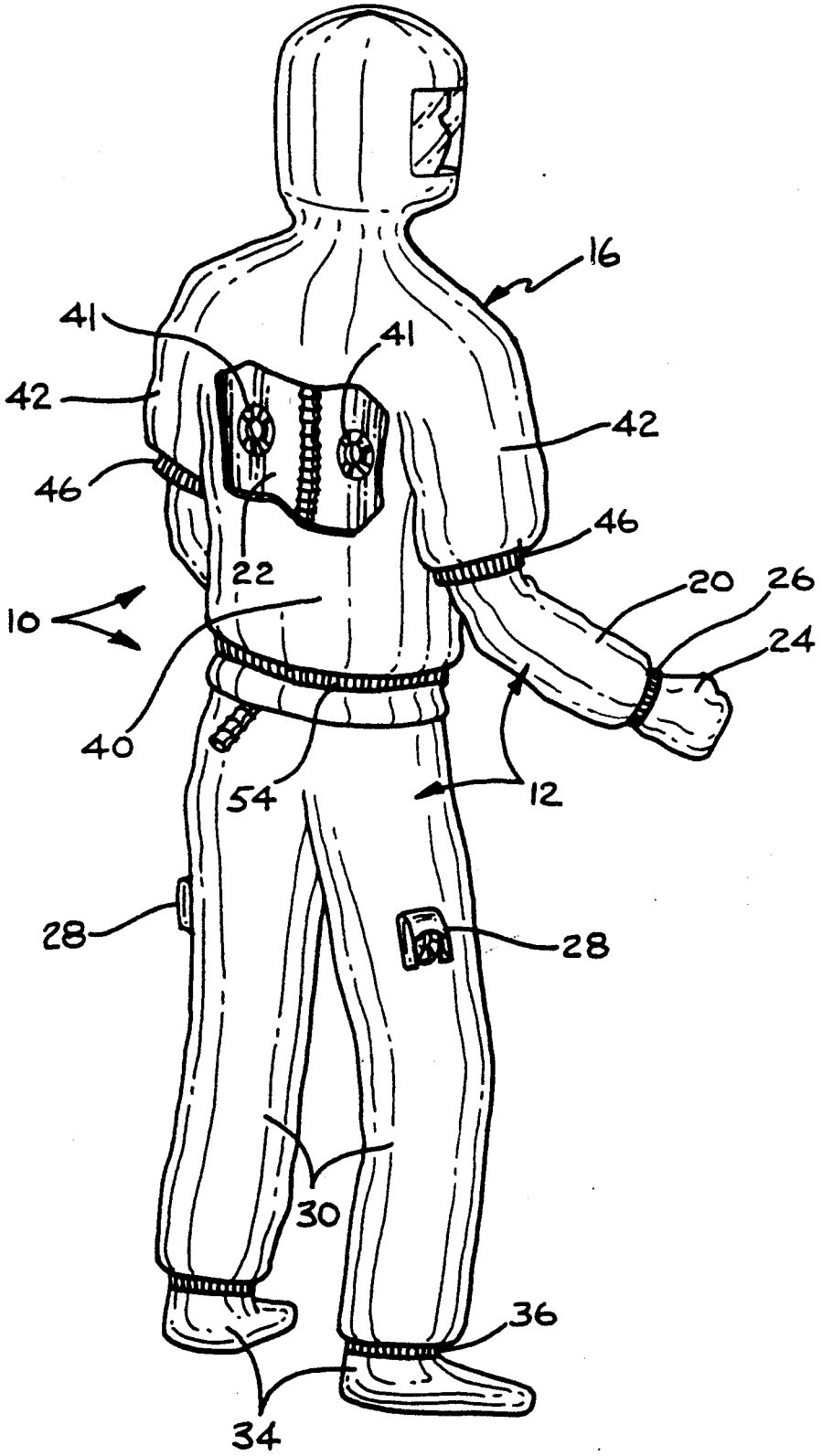
FIG. 1 shows a perspective view of a person wearing a ventilated full body protective garment, thus illustrating a preferred embodiment of my invention.

Referring now to the drawing figures there is shown, in a preferred embodiment of my invention, a worker's full body protective garment 10 for use in contaminated atomspheric evironments. The garment 10 includes two separate and distinct components, one being a flexible full body suit 12 which is slipped on feet first through a manually cinchable neck opening 14, and the other being a flexible slip-over, respirator hooded parka 16.

The body suit 12 features a pair of loose fitting, full length sleeves having inner and outer layers 18 and 20, respectively, extending from a pair of arm openings in a shirt portion 22 thereof. A pair of air impervious gloves 24 are attached in an air tight manner to distal ends of the inner sleeve layers 18 in the region of the wearer's wrists. The outer sleeve layers 20 contain elastic bands 26 around distal end portions thereof for relatively snuggly but comfortably gripping around the wearer's wrists. A pair of conventional exhalation valves 28 are located in outside lateral surfaces of a pair of leg portions 30 of the suit 12 at or just above the level of the wearer's knees for relieving excessive air pressure in the leg portion's 30 so as to enable the wearer to bend extensively at the knees as when climbing a ladder, crouching, kneeling or the like. A pair of relatively loose fitting inner leg portion's 32 attach to inner surfaces of the outer leg portion's 30 at or near the knee level, below the level of the valves 28, and extend downwardly to attach in an air tight manner to flexible fabric foot covers 34 in the region of the wearer's shins. The outer leg portion's 30 contain elastic bands 36 around distal end portions which relatively snuggly, yet comfortably, grip around the wearer's shins over the foot covers 34. A cinch 38, accessable from the front of the suit 12, allows the wearer to manually draw the neck opening 14 around the base of the wearer's neck in a relatively snug but comfortable manner. The foot covers 34 may be made large enough to permit the wearing of ordinary street or work shoes within them as necessary or desirable. On the other hand, due to the flexible nature of the foot covers 34, the same may be worn directly over the wearer's feet, which can then be slipped into boots. The upper back region of the shirt portion 22 contains a pair of laterally spaced apart exhalation valves 41 for relieving excessive air pressure from within the shirt portion 22 of the suit 12 and for introducing pressurized air into the space between the shirt portion 22 and an overlying torso covering portion 40 of the parka 16. This feature thus provides for a pair of overlying positive air pressure barriers, relative to ambient, in the chest, back, shoulder and upper arm region of the wearer for protection of the skin in that area against contact with air borne contaminates which might otherwise infiltrate the suit 12 from the surrounding environment.

The slip-over torso covering portion 40 of the parka 16 contains relatively loose fitting three-quarter length or approximately elbow length sleeves 42 and a head enclosing respirator hood 44 attached to the coat portion 40 around a neck opening thereof. The hood 44 should be attached to the torso covering portion 40 in an airtight manner such as by means of integral connection, thermal seal (where the two components are constructed of plastic) or other suitable and well known means. Distal end portions of the sleeves 42 contain elastic bands 46 which fit snuggly about the inner and outer sleeve portions 18 and 20 and the wearer's arms, preferrably around the upper arms just above the elbows. The parka 16 also includes a conventional shoulder and upper chest and back encircling bib 50 which is attached to and around an annularly extending, neck engaging, air distribution cuff 52 located around the base of the hood 44. An elastic waist band 54 draws a waist portion of the parka 16 relatively snuggly, yet comfortably, around the wearer's waist over and around a waist portion of the body suit 12. Excessive air pressure built up between the torso covering portion 40 of the parka 16 and the shirt portion 22 of the body suit 12 exhausts from the parka 16 across the elastic waist band 54 and, to some extent, across the elastic sleeve bands 46 to allow extensive upper body and arm movements with relative ease.

Pressurized breathing air is supplied under suitable pressure from a conventional remote source to the back of the air distribution cuff 52 through a suitable flexible breathing tube hose 56. The pressurized air thus introduced into the cuff 52 circulates therearound and exits the front through two spaced apart openings 58 located under the wearer's chin. The air exiting the openings 58 circulates upwardly in and around the hood 44 across a plastic viewing window or visor 60 for breathing by the wearer, thence around and over the wearer's head. Excess air circulates downwardly from the hood 44 between and around the wearer's neck and the central opening of the cuff 52, thence downwardly under the bib 50 into the body suit 12 to provide a positive air pressure within and throughout the suit 12. As previously mentioned, excess air pressure in the knee region within the suit 12 is relieved by the exhalation valves 28 in the conventional manner to permit extensive bending of the knees with relative ease. In addition, in accordance with my invention, excess air within the upper back portion of the suit 12 is vented through the valves 41 into the space between the shirt portion 22 of the suit 12 and the torso covering portion 40 of the outer parka 16 to provide a second positive air pressure barrier in the upper body region of the wearer for added protection against infiltration of air borne contaminates from ambient atmosphere into the upper body portion of the suit 10. Excess air within this second positive pressure air barrier is vented to ambient across and around the waist band 54 of the parka 16 and across and around the sleeve bands 46 to allow extensive upper body movements with relative ease, also as previously indicated. The air distribution cuff 52 and attached bib 50, all as connected to the base of the respirator hood 44, is conventional, a more complete description of which can be found in U.S. Pat. No. 4,619,254 issued to A. L. Moretti, et al. on Oct. 28 1986. The flexible fabric of the hood 44, parka 16, bib 50, cuff 52, sleeves 42, body suit 12, gloves 24 and foot covers 34 should be an air impervious, nonwoven, non-stretchable material such as, for example, a spun bound polyolefin available from the DuPont Company and marketed under the brand TYPRO HS. The polyolefin material is preferrably coated with a polymer marketed by DuPont Company under the mark SARANEX.

To apply the garment 10, a worker first slips into the body suit 12 feet first through the cinchable neck opening 14. Before drawing the neck opening 14 around the neck, the hooded parka 16 is applied over the head and the bib 50 is tucked through the neck opening 14. The cinch 38 is then drawn to close the neck opening 14 comfortably 14 about the wearer's neck over the bib 50. The breathing tube 56 is inserted up through the back of the parka 16 and into a flexible air entry port 60 depending from the rear of the cuff 52 and communicating with an annular air distribution channel 62 therein.

Although the present invention has been described with respect to specific details of a certain preferred embodimen thereof it is not intended that such details limit the scope and coverage of this patent other than as specifically set forth in the following claims.

I claim:

1. A ventilatable full body protective garment for use in a contaminated atmospheric environment comprising a body suit including a long pants portion, a shirt portion having a pair of long sleeves and a manually cinchable neck opening, a pair of gloves, and a pair of foot covers, all being joined together in an air tight manner, means for venting excess air from said suit through said shirt portion such that the pressure of air within an upper body region of said suit does not exceed a predetermined maximum value, and a parka including a pull-over torso covering portion having a pair of sleeves with elastic bands and an elastic waist band for closing around the arms and waist, respectively, of a wearer, a supplied air respirator hood attached to and around a neck opening of said torso covering portion, and means for directing excess air from said hood through the neck opening of said shirt portion into said suit, whereby excess air vented from said suit through said shirt portion circulates in a space between said shirt and torso covering portions to form a pair of overlying positive pressure air barriers in the upper body region of the garment to inhibit exposure of a wearer to air borne contaminates contained in the ambient atmosphere, and excess air is vented from said space to ambient atmosphere through said waist and sleeve bands, said suit and parka being constructed of a flexible, air impervious non-stretchable material.

2. The garment of claim 1 wherein said venting means includes a pair of laterally spaced apart exhalation valves.

3. The garment of claim 1 wherein said venting means is located in the back of the shirt portion of said body suit.

4. The garment of claim 1 further comprising means for venting excess air from the legs of said pants portion to ambient atmosphere to enable a wearer to bend at the knees through a substantial range with relative ease.

5. The garment of claim 1 wherein said body suit and the torso covering portion of said parka are adapted for relatively loose fitting upon a wearer.

6. The garment of claim 1 wherein the sleeves of said shirt portion each include an inner and outer layer, said pair of gloves being joined to the inner layers of said sleeves.

7. The garment of claim 1 wherein each leg of the pants portion of said body suit includes an outer layer having an interior surface and an inner layer, said inner layer being attached to the interior surface of said outer layer at about the knee level of a wearer and extending at least to a region near the end of said outer layer, said foot covers being joined to the ends of said inner layers.

8. The garment of claim 1 wherein said respirator hood includes an annular, neck encirclable air distribution cuff attached around a base portion thereof, said excess air directing means being attached to said cuff.

9. The garment of claim 1 wherein said parka and suit further comprises a back portion defining an access opening through which an air hose can be inserted for supplying breathable air to said respirator hood.

10. The garment of claim 1 wherein said excess air directing means comprises a shoulder and upper chest and back encircling bib attached to and around a base portion of said hood and being disposed under said torso covering portion.

11. A full body protective garment for use in a contaminated atmospheric environment comprising a body suit including a shirt portion having long sleeves, a neck opening, long pants, a pair of gloves attached to said sleeves, and a pair of foot covers attached to the legs of said pants, a parka including a torso covering portion having sleeves containing elastic bands on end portions thereof for snugly grabbing the arms of a wearer, and an elastic waist band, said parka also including a respirator hood attached about a neck opening of said torso covering portion, and means for directing excess air from said hood through the neck opening of said shirt portion into said suit, said suit and parka being constructed of a flexible, non-stretchable, air impervious material whereby excess air expelled from said suit by said venting means circulates in a space between said shirt and torso covering portions to form a pair of overlapping positive pressure air barriers in an upper body portion of said garment, excess air being ventilatable from said space to ambient atmosphere through said waist and sleeve bands for permitting extensive upper body movements of the wearer with relative ease.

* * * * *